United States Patent [19]

Kobayashi

[11] Patent Number: 4,848,261

[45] Date of Patent: Jul. 18, 1989

[54] ANCHOR

[76] Inventor: Satoru Kobayashi, 33-8 Taishido 5-chome, Setagaya-ku, Tokyo 154, Japan

[21] Appl. No.: 182,183

[22] Filed: Apr. 15, 1988

[30] Foreign Application Priority Data

Jun. 19, 1987 [JP] Japan ..... 62-151369

[51] Int. Cl.[4] ..... B63B 21/24

[52] U.S. Cl. ..... 114/299; 294/66.1

[58] Field of Search ..... 114/297–299, 114/310, 311, 217, 304, 378, 379; 294/66.1, 82.33

[56] References Cited

U.S. PATENT DOCUMENTS

| | | | |
|---|---|---|---|
| 7,207 | 3/1850 | Bell | 114/311 |
| 2,490,460 | 12/1949 | McAvoy | 114/299 |
| 2,669,962 | 6/1954 | Christie | 114/299 |
| 2,764,116 | 9/1956 | Brewer | 114/299 |
| 3,150,629 | 9/1964 | Fields | 114/299 |
| 3,762,357 | 10/1973 | Ehrhardt | 114/298 |
| 3,841,255 | 10/1974 | Mansfield | 114/299 |
| 4,565,026 | 1/1986 | Bohme | 43/17.2 |
| 4,721,054 | 1/1988 | Kobayashi | 114/299 |

FOREIGN PATENT DOCUMENTS

| | | | |
|---|---|---|---|
| 2066192 | 7/1981 | United Kingdom | 114/298 |
| 1328456 | 8/1988 | United Kingdom | 114/299 |

*Primary Examiner*—Joseph F. Peters, Jr.
*Assistant Examiner*—Jesûs D. Sotelo
*Attorney, Agent, or Firm*—Laff, Whitesel, Conte & Saret

[57] ABSTRACT

An improved anchor which can be easily separated massive obstacles merely by pulling the anchoring line. The anchor comprises a shank having a crown end and a rotatable shaft attached to the crown end and extending substantially perpendicular to the longitudinal axis of the shank, at least one fluke mounted on the shaft, locking device for restricting the rotational movement of the shaft within an angular range so that the angle of the fluke relative to the axial direction of the shank is below 90° under normal locking condition, and unlocking device for shifting the locking device from the normal locking condition to a condition at which the shaft is allowed to rotate so that the angle of the fluke relative to the axial direction of the shank becomes more than 90°, the unlocking device being connected to an anchoring line through an anchor retrieving device.

6 Claims, 9 Drawing Sheets

ANCHOR

BACKGROUND OF THE INVENTION

1. Field of the Invention

The present invention relates to an anchor which can be easily separated from massive obstacles on the bottom of a body of water to be ready for anchor raising operation even if it is caught by any obstacles, such as roots or ledges of rocks or submerged timbers or like.

2. Related Art Statement

It might often arise a case where an anchor becomes snagged by roots, rocks or like to make it impossible to raise the anchor to the boat. In order to release the anchor and to bring the same in the condition for easy raising, I have previously proposed an anchor arrangement. The anchor arrangement according to my previous proposal, comprises a flexible rope having a free end, retaining device for detachably retaining the free end of the rope and being attached to the rope and normally held at a position separated from the free end of the rope by a certain distance, an anchor attached to the rope and having a shank and at least one grasping means (fluke in one embodiment) extending backwardly from one end of the shank for grasping a rock at the bottom of a body of water. The shank of the anchor is attached to the rope so that the one end formed with the fluke is positioned remoter from the free end of the rope. The arrangement further comprises means for opening the retaining device so that the free end of the rope is released therefrom in readiness for the anchor raising operation, upon impingement or striking by a weight.

The anchor arrangement of my prior proposal is disclosed in my co-pending U.S. patent application Ser. No. 06/865,115 which was filed while claiming a Convention Priority based on Japanese Patent Appln. No. 115232/1985 (Japanese Patent Laid-Open Publication No. 275085/1986), and a corresponding European patent application was also filed and given with EPC No. 86303937.6. This is also disclosed in my Japanese Patent Appln. No. 173924/1986. The specification of the aforementioned U.S. patent application will be incorporated herein as a reference.

In my previous arrangement, a tension for anchoring a boat or ship is transmitted through a main anchoring line or rope which is connected to one end of the shank remote from the end on which flukes are mounted under normal anchoring condition, and a pulling force is transmitted through an auxiliary rope or anchor retrieving line which is connected to the crown end of the shank on which the flukes are mounted to pull the flukes in the direction for separating them from the obstacles which catch them to hinder the anchor to be raised.

However, this arrangement has a disadvantage that the length of the anchor retrieving line connected to the crown end of the shank becomes too long and tends to cling to the flukes or other parts of the anchor as the anchor is thrown into water. Another disadvantage of the anchor device of my previous proposal is that the pulling force needed for separating the flukes of the anchor from the massive obstacles is transmitted through the main anchoring line to the relatively weak auxiliary line, even when a considerably high pulling force is needed for releasing the flukes which are caught, for example, by roots or submerged timbers of complicated shape. In order that the anchor retrieving line has sufficient strength for withstanding such relatively high tension or pulling force, it is necessary to use a relatively thick rope to increase the volume of the auxiliary rope.

OBJECTS AND SUMMARY OF THE INVENTION

The primary object of this invention is to provide an anchor having anchor retrieving device wherein a short and relatively thin anchor retrieving line is used to obviate the aforementioned disadvantages.

Another object of this invention is to provide an improved anchor having locking means for limiting the angular movement of the flukes relative to the shank during normal anchoring operation, the locking means being unlocked to allow free rotation of the flukes about an axis which is perpendicular to the longitudinal direction of the shank when it is desired to separate the flukes from any massive obstacles hindering the anchor raising operation.

A more specific object of this invention is to provide an improved anchor wherein the angle of the flukes relative to the shank is limited within an angular range of below 90° under normal anchoring condition, and the angle of the flukes relative to the shank is increased to subtend an obtuse angle (more than 90°) so that the anchor is raised with its crown end held upsides.

Another object of this invention is to provide such an anchor which can be retrieved from snagged situation by a simple operation from an operator who gets aboard of the boat or ship.

With the aforementioned objects in view, the present invention provides an anchor comprising a shank having a crown end and a rotatable shaft attached to said crown end and extending substantially perpendicular to the longitudinal axis of said shank, at least one fluke mounted on said shaft, lock means for restricting the rotational movement of said shaft within an angular range so that the angle of said fluke relative to the axial direction of said shank is below 90° under normal locking condition, and unlocking means for shifting said lock means from said normal locking condition to a condition at which said shaft is allowed to rotate so that the angle of said fluke relative to the axial direction of said shank becomes more than 90°, said unlocking means being connected to an anchoring line through an anchor retrieving device.

In a preferred embodiment, said lock means comprises a generally circular cam disk having a portion of its circumferential periphery cut out to define a recessed segment subtending an angular range of below 180°, a lock key having one end received in said recessed segment under normal condition, and biasing means for biasing said one end of said lock key onto said recessed segment of said cam disk so that angular movement of said shaft is restricted within an angular range of below 180°.

DESCRIPTION OF THE APPENDED DRAWINGS

The above and other objects and merits of this invention will be easily understood by those skilled in the art by reading the following detailed description of a presently preferred embodiment thereof while referring to the appended drawings, in which.

DESCRIPTION OF THE PREFERRED EMBODIMENT

Figure 1:
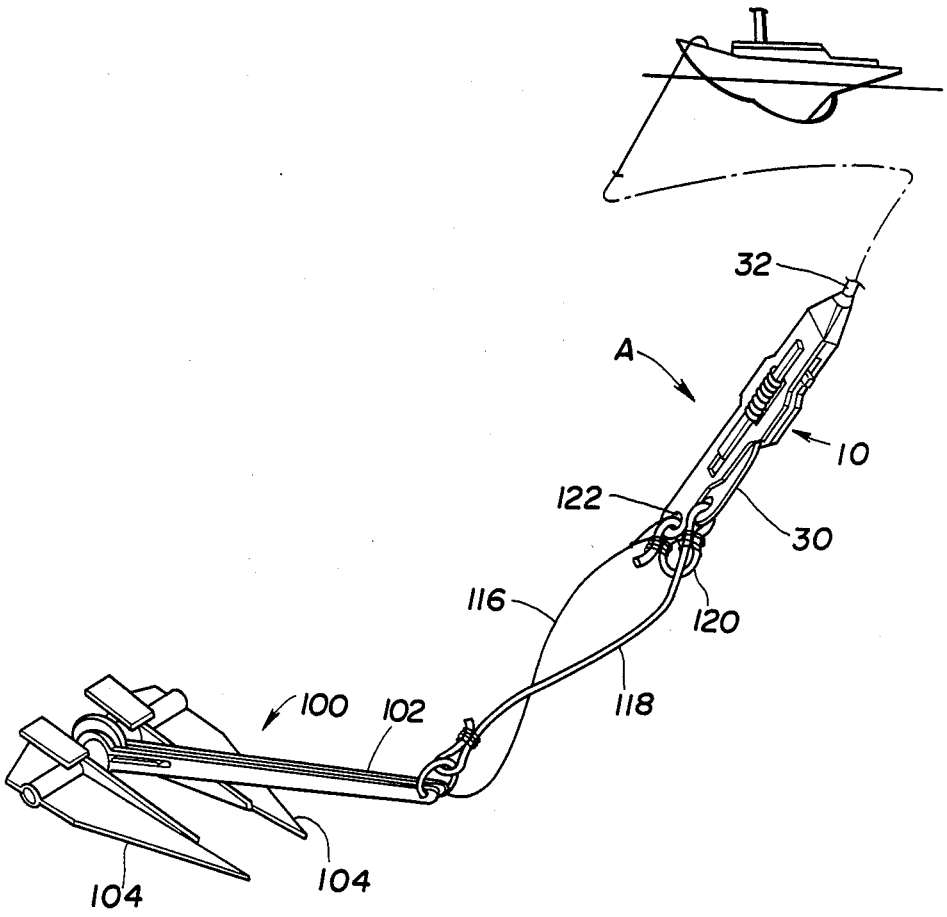
FIG. 1 is a diagrammatic illustration showing one embodiment of this invention which is in the normal anchoring condition.

The present invention will now be described in detail by referring to a presently preferred embodiment thereof.

Referring to the drawings, particularly to FIGS. 8 to 11, the structure and operation of an anchor retrieving device used in combination of the embodiment of this invention will be initially described. In FIGS. 8 to 11, the anchor retrieving device is generally denoted by A which comprises a lock assembly 10 and a releaseable hook member 30. The lock assembly 10 has an upper end connected to a main anchoring line 32. The lock assembly 10 also has a housing 11 which is defined by a core plate 12, paired side wall plates 14, 16 securedly fitted to cover the sides of the core plate 12 by welding or using screws or other securing means, each of the side wall plates 14, 16 having a longitudinal slot 18 extending along the longitudinal direction of the housing 11. A pair of guide rods 20, 20 are housed in the longitudinal slots 18, 18 of the side wall plates 14, 16 to be moved along the longitudinal direction. An upper crossing member 22 is pivotally carried at an upper portion of the guide rods 20, 20, and a lock pawl 24 is carried by the lower end of the guide rods 20, 20. A coil spring 26 surrounds the guide rods 20, 20 and has a lower end circumference seated on the bottom ledges of enlarged portions or windows 28 of the longitudinal slots 18. The top end circumference of the coil spring 26 abuts against the bottom of the upper crossing member 22 to urge the member 22 maintained at its upper position under normal condition when no striking force is applied on the member 22. Both ends of the upper crossing member 22 protrude beyond the side wall plates 14, 16 to be struck by a weight 34 as will be described hereinafter.

The guide rods 20, the upper crossing member 22 and the lock pawl 24 are thus connected together and movably housed in the housing 11 of the lock assembly 10 while being applied with a biasing force by the coil spring 26 to form a movable locking block 27.

A releaseable hook member 30 is contained in the housing 11 of the lock assembly 10 securedly in the anchoring condition as it is contained in the housing 11 of the lock assembly 10 to be set for anchoring, and it is readily released from the lock assembly 10 in response to the operation by a person who is staying on the boat when it is desired to separate the anchor from any massive obstacle which hinders raising of the anchor. Now referring to the drawings, particularly to FIGS. 10 and 11, the releaseable hook member 30 has a thickness slightly thinner than the wall thickness of the core plate 12 to be loosely set in the gap or space between the side wall plates 14 and 16, and has a generally crescent shape in the illustrated embodiment. The releaseable hook member 30 has at its one end, which would be referred to as the "lower end" in some portions of the following description for the convenience of description, a rounded lug or first hook end 30*a* which is snugly received by a cut-out 12*a* formed at the lower portion of the core plate 12 and covered by the side wall plates 14 and 16. The cut-out 12*a* has an opening which is slanting at a certain angle relative the longitudinal direction of the side wall plates 14, 16 so that the first hook end 30*a* is inserted from the upside of the cut-out 12*a* at the initial step for connecting the hook member 30 with the lock assembly 10. The other end, which would be referred to as the "upper end" in some portions of the following description for the convenience of description, forms a latch end 30*a* for engaging with the lock pawl 24.

In order to connect the lock assembly 30 with the lock assembly 10 to set the same to normal anchoring condition, the first hook end 30*a* of the hook member 30 is inserted in the cut-out 12*a* at the lower portion of the lock assembly 10, and then the upper portion of the hook member 30 is pushed in the space between the both side wall plates 14, 16 whereupon the latch end 30*b* of the hook member 30 pushes the lock pawl 24 downwards against the biasing force of the coil spring 26. As the inner face of the latch end 30*b* engages with the latch seat formed on the backside of the lock pawl 24 and the movable locking block 27 is moved again to the upper position under the action of the coil spring 26, the releaseable hook member 30 is securedly and firmly locked by the lock assembly 10.

Figure 2:
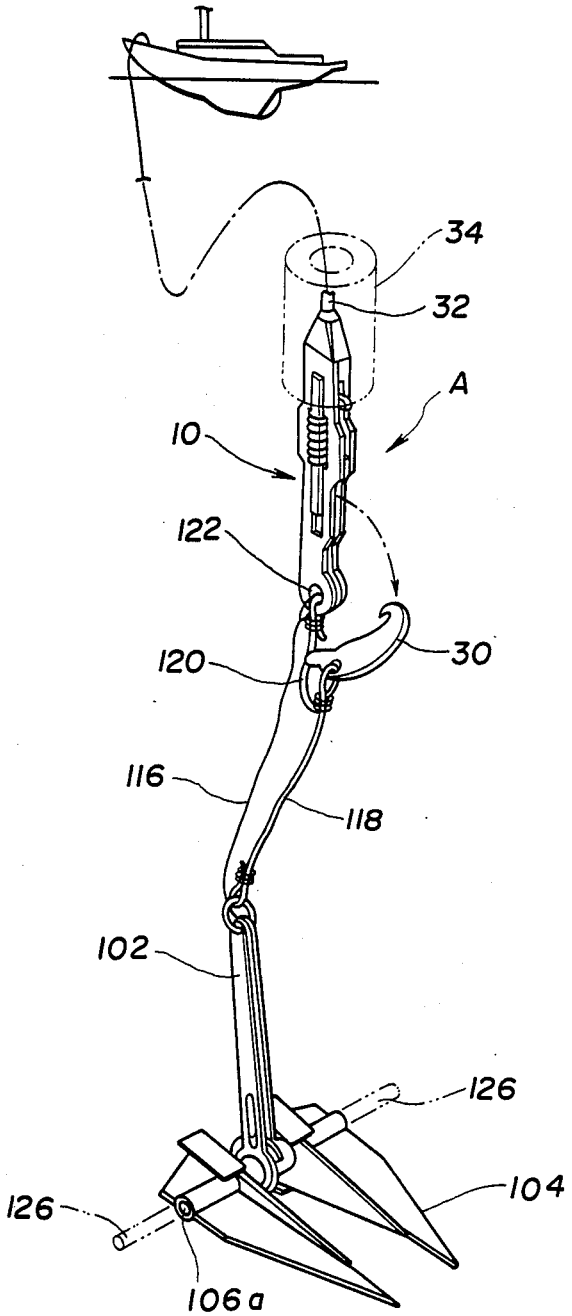
FIG. 2 is a view similar to FIG. 1, showing the same embodiment as in FIG. 1, in which the releaseable hook member is released from the lock assembly to be ready for anchor raising operation.
Figure 11:
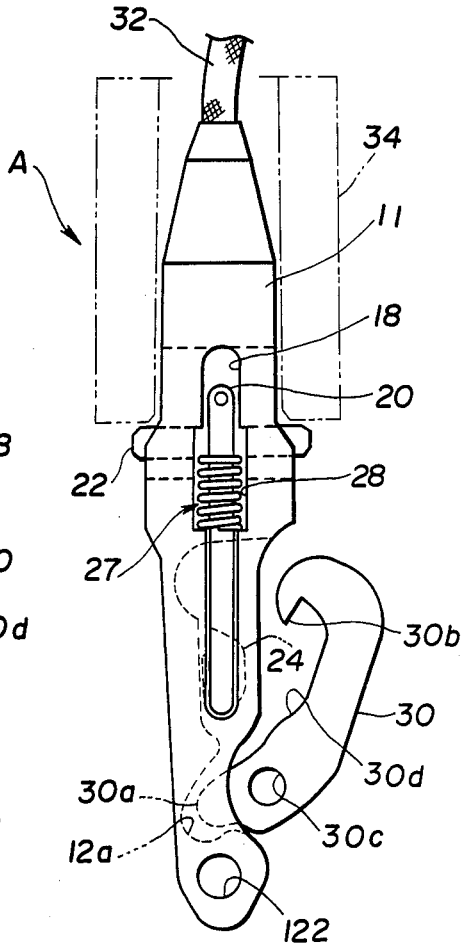
FIG. 11 is a view similar to FIG. 10, with the releaseable hook member being unlocked from the lock assembly.

The top ends of both side wall plates 14, 16 are connected through an untwisting arrangement (not shown) to the main anchoring line 32 drawn out from the boat, and have side edges or shoulders slanting to converge upwardly. A generally cylindrical weight 34 is shown in FIGS. 2 and 11, and the weight 34 in this embodiment is composed of two half-cylinders connected with each other by hinges (not shown) to be opened and closed as desired, the weight 34 being fixed to its closed condition by means of locking means (not shown).

An embodiment of the anchor, according to this invention, will now be described in detail with reference to FIGS. 3 to 7.

Figure 7:
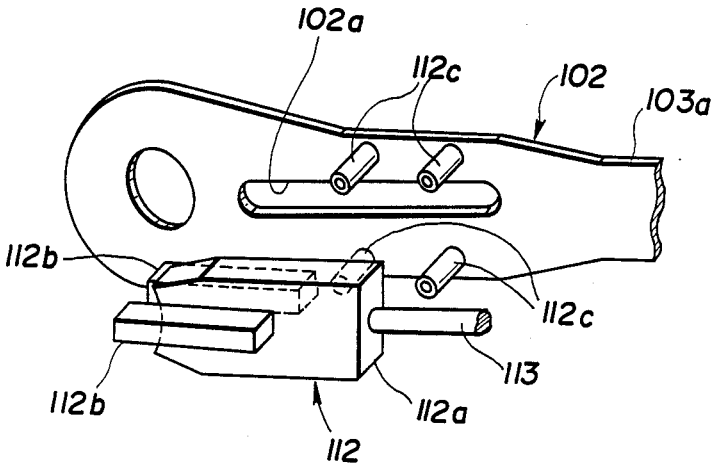
FIG. 7 is a perspective view diagrammatically showing parts of the lock means in enlarged scale.
Figure 8:
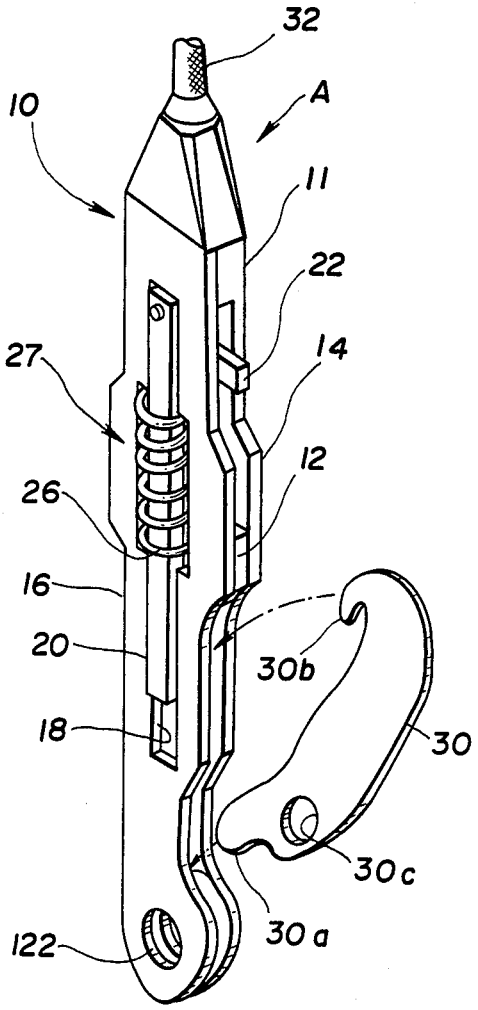
FIG. 8 is a perspective view showing an anchor retrieving device which is combined with one embodiment of this invention, with parts omitted for simplicity of illustration.
Figure 9:
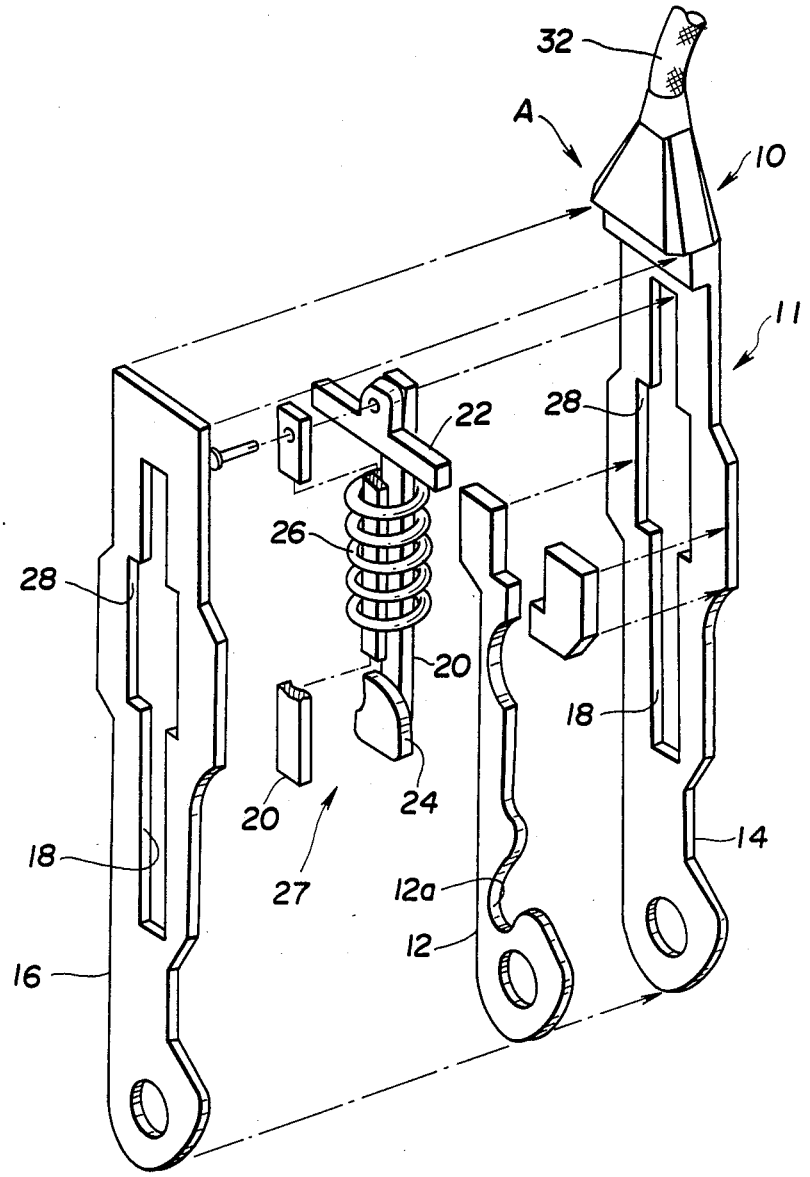
FIG. 9 is an exploded perspective view showing the parts of the anchor retrieving device shown in FIG. 8, with portions of some members being cut away for easy understanding.
Figure 10:
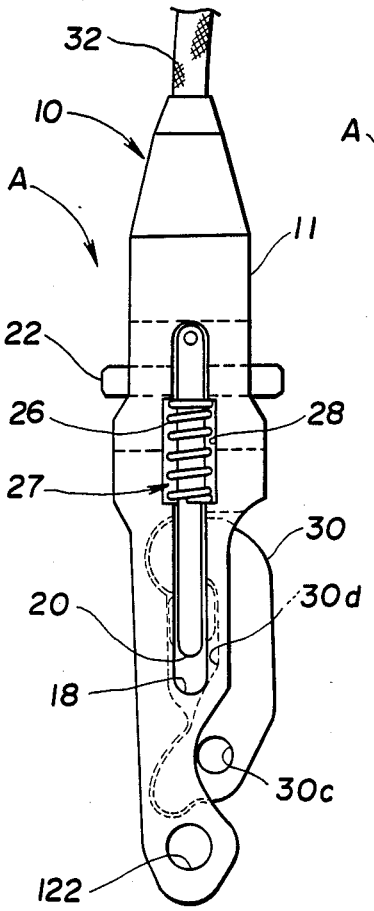
FIG. 10 shows an elevation of the anchor retrieving device used in combination with the anchor of this invention, wherein the releaseable hook member is housed in the lock assembly to be locked by the latter.

The anchor 100 comprises a shank 102, and two flukes 104 swingably attached to the crown end of the shank 102. The anchor 100 further comprises locking means 100A for limiting the swinging angle of the flukes 104 under normal anchoring position, and unlocking means 100B for unlocking the lock means 100A to allow the flukes 104 to swing beyond the limited angular range. In the illustrated embodiment, the shank 102 is formed of two elongated plates 103*a*, 103*b* placed face-to face relationship with each other spaced by a certain gap. A shaft 106 having a hexagonal section extends through the fore ends (crown ends) of the two elongated plates 103*a*, 103*b*, and a cam disk 108 is mounted on the shaft 106 to be rotated within the gap defined by the two elongated plates 103*a*, 103*b*. A pair of flukes 104 are fixed to the shaft 106 to be carried by the ends of the shaft 106. As the shaft 106 becomes swingable relative to the center axis of the shank 102, these flukes 104 are swung together with the rotational movement of the shaft 106. As will be seen from FIG. 4, the cam disk 108 has a portion cut out to define a recessed segment 110 subtending an angular range of below 180°. As shown in FIG. 7, the lock key 112 comprises a main block 112*a* slidably interposed between the two plates 103*a*, 103*b* forming the shank 102, and lugs 112*b*, 112*b* protruding from the side faces of the main block 112*a*. The lugs 112*b*, 112*b* are guided by elongated guide slots 102*a*, 102*a* formed through the plates 103*a*, 103*b* to be slidingly moved along the longitudinal direction of the shank 102. The top and bottom faces of the main block 112*a* contact slidingly with four guide pins 112*c* extending through the two plates 103*a*, 103*b* forming the shank 102.

Figure 3:
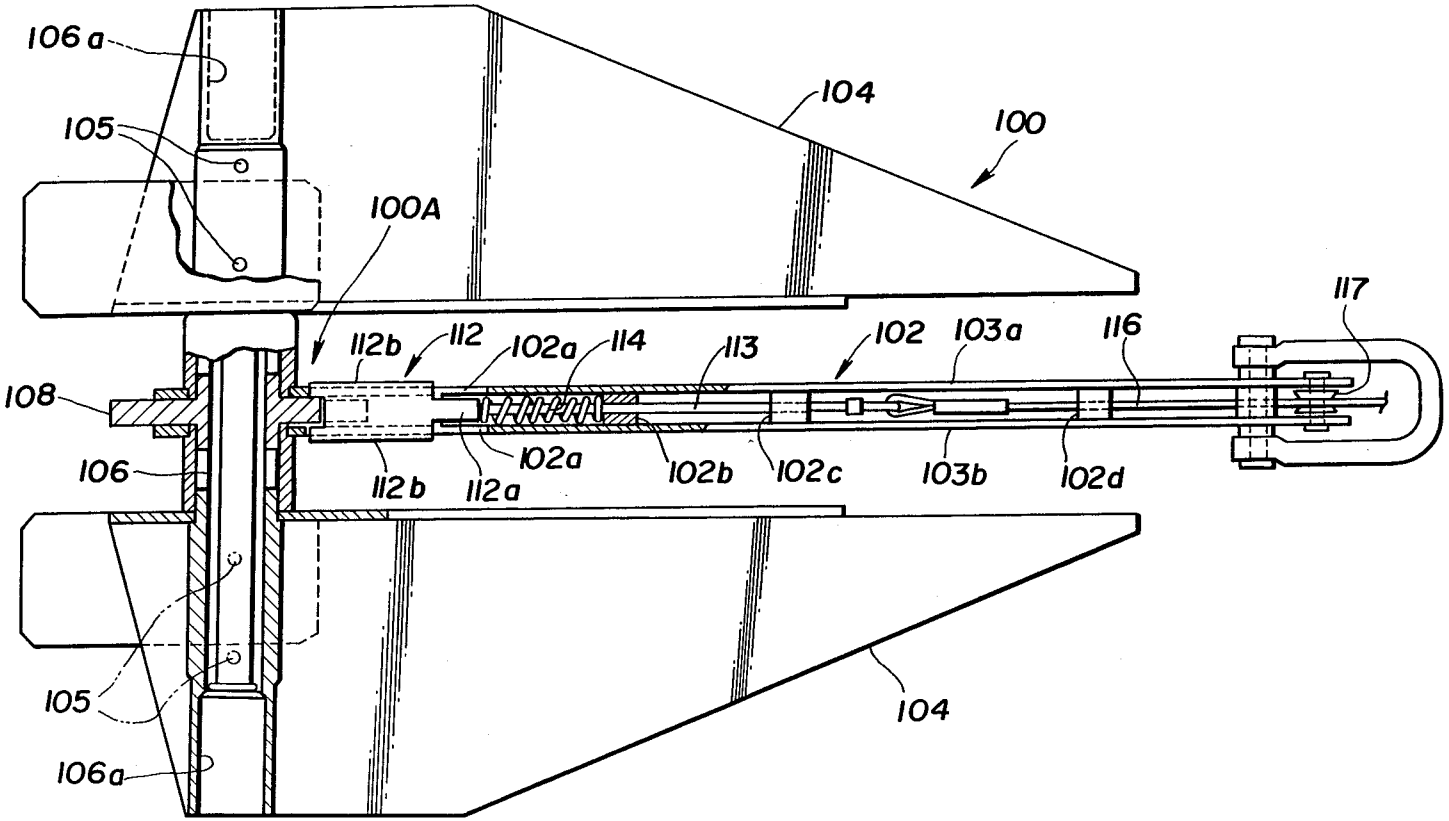
FIG. 3 is a plan view of the anchor shown in FIGS. 1 and 2, with portions shown in section.
Figure 4:
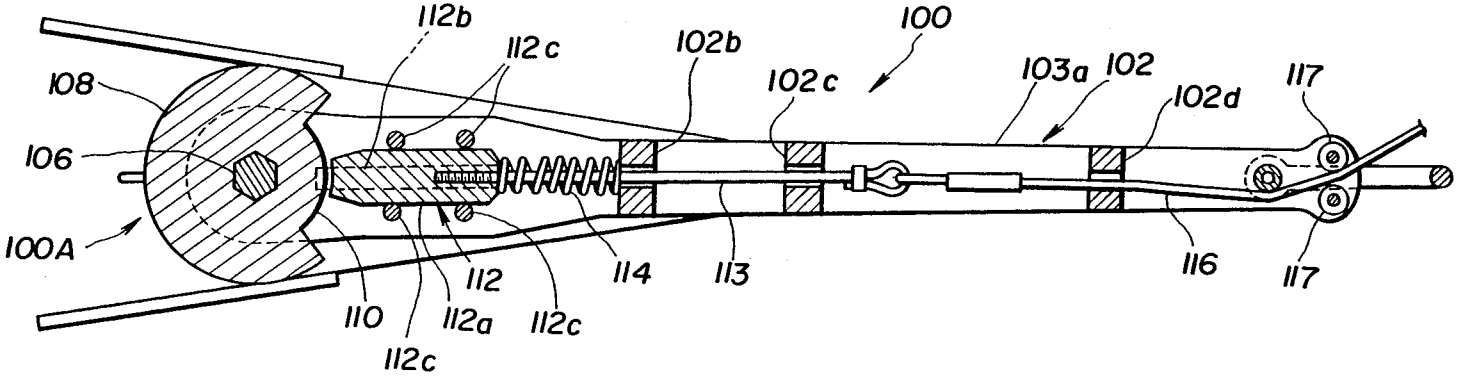
FIG. 4 is a side elevation of the anchor shown in FIG. 3.

A rod 113 is screwed to the rear end face of the main block 112*a* and extends in the radial direction of the shaft 106. The rod 113 extends through span blocks 102*b* and 102*c* extending across the gap between the interior surfaces of the plates 103*a*, 103*b*. As shown in FIGS. 3 and 4, a spring 114 acting as biasing means is disposed between the main block 112*a* and the span block 102*b* in a compressed condition, so that the lock key 112 is urged towards the cam disk 108. The rod 113 is connected to an anchor retrieving line or cable 116 which extends, through the span block 102*d* disposed internally of the shank 102 and through the gap between paired pulley blocks 117 and 117 attached at the end of the shank 102, to the outside of the shank 102. Thus, when the cable 116 is pulled in the right-hand direction in FIGS. 3 and 4, the lock key 112 can be disengaged from the recessed segment 110 of the cam disk 108 against the biasing force of the spring 114.

Figure 5:
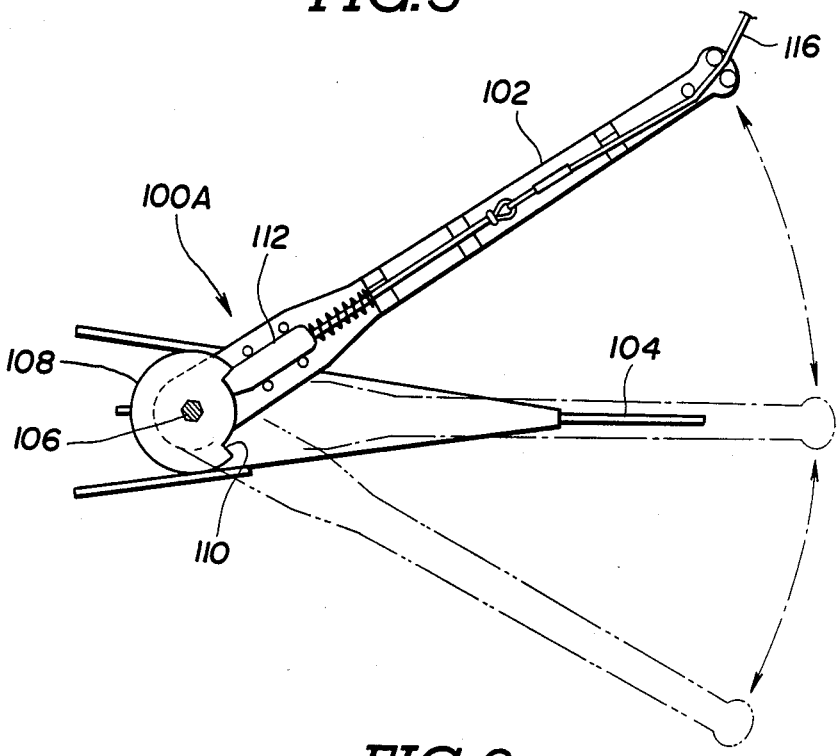
FIGS. 5 and 6 are schematic illustrations showing the angular ranges within which the shank may be swung, the angular range shown in FIG. 5 being that when the lock means is in its locking position, the angular range shown in FIG. 6 being that when the lock means is unlocked.

Under the condition where no tension for pulling the rod 113 is transmitted through the line or cable 116, the cam follower end of the lock key 112 is received in the recessed segment 110 of the cam disk 108 so that the angular range within which the cam disk 108 and the shaft 106 and the flukes 104 are allowed to swing is limited to the acute angle range (below 90°) as shown in FIG. 5. As the line or cable 116 is pulled to allow the lock key 112 to come out of the recessed segment 110, the shaft 106 is released from the condition where the rotational movement thereof is limited, so that the flukes 104 are brought in the condition for free rotation covering the angular range of 360°.

In a broad sense, locking means 100A is provided for restricting the rotational movement of the shaft 106 within an angular range so that the angle of the fluke 104 relative to the axial direction of the shaft 102 is retained below 90° under normal locking condition. In the illustrated embodiment, the locking means 100A comprises the cam disk 108 having the recessed segment 110, and the lock key 112 having the cam follower end. Unlocking means 100B is provided in order to shift the locking means 100A from the normal locking condition to the condition at which the shaft 106 is allowed to rotate so that the angle of the flukes 104 relative to the axial direction of the shank 102 becomes more than 90°. In the illustrated embodiment, the unlocking means comprises the combination of the rod 113 and the unlocking line 116.

As shown in FIGS. 1 and 2, the anchor 100 is connected to the lock assembly 10 and the releaseable hook member 30 in the manner as described with reference to FIGS. 8 to 11. In detail, the end of the shank 102 opposite to the crown end is connected to the lower end of the hook member 30 through the major line segment 118 and the link, and the first hook end 30*a* is received in the cut-out 12*a* at the lower end of the lock assembly 10 (see FIGS. 10 and 11). The major line segment 118 is joined with one end of the minor line segment 120, and the other end of the minor line segment 120 is connected to the hole 122 formed at the lower end of the lock assembly 10, the hole 122 of the lock assembly 10 also holds the other end, i.e. the end opposing to the end bound to one end of the shank 102, of the anchor retrieving line or flexible power transmission element 116.

It is noted here that the length of the major line segment 118 is slightly shorter than that of the anchor retrieving line 116, and the total length of the major line segment 118 plus minor line segment 120 is slightly longer than the length of the anchor retrieving line 116. The major line segment 118 and the minor line segment 120 constitutes a connection line for transmitting an anchor raising power during the anchor raising operation.

Accordingly, under the condition shown in FIG. 1 where the hook member 30 is connected to the lock assembly 10, anchoring force is transmitted from the anchor 100 through the major line segment 118 and through the lock assembly 10 to the main anchoring line 32. Since the anchor retrieving line 116 is slack and no force is transmitted therethrough, the fore end (cam follower end) of the lock key 112 is received in the recessed segment 110. As a result, the swinging angular range of the flukes 104 is limited within the range defined by the angle of the recessed segment 110 as shown in FIG. 5, so that the flukes 104 swing relative to the axis of the shank 102 within a designed angular range, generally within an angular range of below 90° to allow the entire anchor assembly 100 to act as a usual anchoring device.

Figure 6:
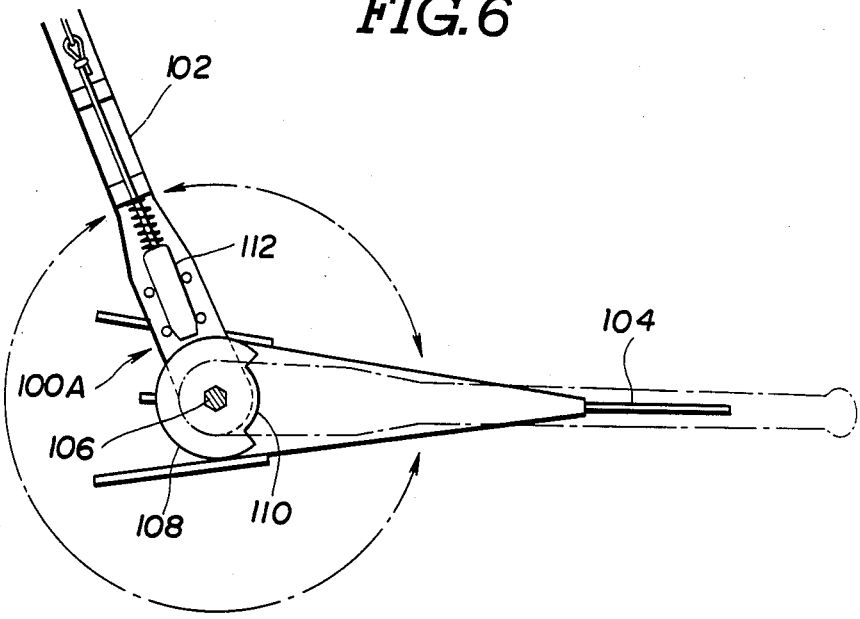

In an event where either one or both of the flukes 104 is caught by some massive obstacle to render the anchor 100 to become snagged, the weight 34 is dropped along the main anchoring line 32 to strike the top of the lock assembly 10, whereupon the releaseable hook member 30 is released from the lock assembly 10. In this condition, since the total length of the major and minor line segments 118 and 120 is longer than the length of the anchor retrieving line 116, the anchor raising force is transmitted from the line 32 to the line 116 so that fore end of the lock key 112 is allowed to come out of the recessed segment 110. As shown in FIG. 6, the shank 102 is now allowed to rotate around the whole circumference of the shaft 106 in this condition. At the initial stage of hauling the line 32, the pulling force is transmitted through the line 116 which in turn pulls the lock key 112, so that the shank 102 is rotated in the direction to bring the angle between the shank 102 and the flukes 104 into an obtuse angle. Thus, the flukes 104 are pulled from the base ends, i.e. the crown end of the shank 102, to be released from the massive obstacle which hinders anchor raising operation. It should be noted here that the line 116 is utilized only to transmit a pulling force necessary for pulling the lock key 112 against the biasing force of the spring 114, and relatively high pulling force needed to release the flukes 104 and to raise the anchor 100 upwardly is transmitted through the minor line segment 120 and the major line segment 118 to the shank 102 to prevent the line 116 from being applied with excessively high extension which might break down the relatively weak line 116.

Although the angular range within which the shank 102 is swingable is restricted by the lock means 100A comprising the cam disk 108 having the recessed segment 110 and the co-operating lock key 112 in the illustrated embodiment, the present invention is not restricted only to such design. The object of this invention can be achieved by limiting the swinging action of the flukes 104 relative to the axis of the shank 102 so that the angle between them is an acute angle under normal anchoring operation by the provision of lock means 100A which is unlocked to allow the flukes to swing so that the angle of the plane of flukes 104 relative to the axis of the shank 102 is increased beyond 90°.

As will be seen from FIG. 3, the shaft 106 of the illustrated anchor 100 has ends formed with openings 106*a* into which stocks 126 may be inserted. Stocks 126 may be inserted into the openings 106*a* to extend in the lateral direction so that the anchor 100 catches sands or rocks in a more stable condition. It is preferable that the stocks 126 are made of a material having a relatively low bending strength, such as wood or coil spring, to be bent or broken by the application of a high pulling force when they are caught tightly by any massive obstacles.

The flukes 104 are secured to the shaft 106 by means of pins 105, and may be replaced by other flukes 104 of different shape in consideration of the condition of the bottom of a body of water. For instance, flukes 104 each having a large surface area may be used when the anchor 100 is cast onto the bottom which is mainly composed of sand, and flukes 104 each having multiple projections or tips may be used when the anchor 100 is cast onto the bottom on which a number of rocks are present.

What is claimed is:

1. An anchor comprising a shank having a crown end and a rotatable shaft attached to said crown end and extending substantially perpendicular to the longitudinal axis of said shank, at least one fluke mounted on said shaft, locking means for restricting the rotational movement of said shaft within an angular range so that the angle of said fluke relative to the axial direction of said shank is less than 90° under normal locking condition, and unlocking means for shifting said locking means from said normal locking condition to a condition at which said shaft is allowed to rotate so that the angle of said fluke relative to the axial direction of said shank becomes more than 90°, said unlocking means being connected to an anchoring line via an anchor retrieving device, wherein the end of said shank opposite to said crown end is connected to a main anchoring line via a connection line having a certain length, and wherein said unlocking means is a flexible power transmission element having a length slightly longer than said connection line.

2. The anchor according to claim 1, wherein said locking means comprises a generally circular cam disk having a portion of its circumferential periphery cut out to define a recessed segment subtending an angular range of below 180°, a lock key having one end received in said recessed segment under normal condition, and biasing means for biasing said one end of said lock key onto said recessed segment of said cam disk so that angular movement of said shaft is restricted within an angular range of below 180°.

3. The anchor according to one of the claims 1 or 2, wherein said fluke is detachably mounted on said shaft.

4. The anchor according to one of the claims 1 or 2, wherein said shaft has an opening for receiving therein a stock.

5. The anchor according to claim 4, wherein said stock is made of a material having a relatively low bending strength.

6. The anchor according to claim 4, wherein said stock is made of a flexible material.

* * * * *